US007543423B2

(12) United States Patent
Long et al.

(10) Patent No.: US 7,543,423 B2
(45) Date of Patent: Jun. 9, 2009

(54) VERTICAL CARTON LOADING PROCESS AND SYSTEM FOR CLIPS OF A STACKED SHEET MATERIAL

(75) Inventors: Leslie T. Long, Appleton, WI (US); Daniel S. Grubb, Jr., Appleton, WI (US); Zachary J. Henderson, Menasha, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 268 days.

(21) Appl. No.: 11/302,305

(22) Filed: Dec. 13, 2005

(65) Prior Publication Data

US 2007/0130891 A1 Jun. 14, 2007

(51) Int. Cl.
*B65B 5/06* (2006.01)
*B65B 1/04* (2006.01)

(52) U.S. Cl. ..... 53/252; 53/237; 53/247

(58) Field of Classification Search ..... 53/237, 53/241, 247, 249, 250, 251, 252
See application file for complete search history.

(56) References Cited

U.S. PATENT DOCUMENTS

| | | | |
|---|---|---|---|
| 2,611,482 | A | 9/1952 | Nelson |
| 3,292,340 | A | 12/1966 | Smith, Jr. et al. |
| 3,369,700 | A | 2/1968 | Nelson |
| 3,805,482 | A | 4/1974 | O'Shea et al. |
| 4,751,807 | A | 6/1988 | Couturier |
| 5,215,757 | A | 6/1993 | El-Nokaly |
| 5,599,555 | A | 2/1997 | El-Nokaly |
| 5,980,931 | A | 11/1999 | Fowler et al. |
| 6,121,165 | A | 9/2000 | Mackey et al. |
| 6,202,392 | B1 | 3/2001 | Greenwell et al. |
| 6,685,050 | B2 | 2/2004 | Schmidt et al. |
| 6,698,163 | B2 | 3/2004 | Greenwell et al. |
| 2005/0218151 | A1 | 10/2005 | Osborne et al. |

OTHER PUBLICATIONS

PCT Search Report and Written Opinion for PCT/US2006/026453, Nov. 3, 2006.

*Primary Examiner*—Rinaldi I. Rada
*Assistant Examiner*—John Paradiso
(74) *Attorney, Agent, or Firm*—Dority & Manning, P.A.

(57) ABSTRACT

A system and process for packaging sheet materials is disclosed. In particular, the system and process of the present invention is configured to receive clips of a sheet material and to load the clips into a dispenser. During the process, the clips can be folded and loaded into vertical buckets that are positioned over a stream of moving dispensers. A vertical pushing device then pushes the clip from the vertical buckets down into the dispensers. In this manner, the dispensers are loaded from the top. Since the dispensers are loaded from the top, the system is capable of placing clips of a material into dispensers having a complex configuration, such as dispensers having curved side walls.

13 Claims, 10 Drawing Sheets

34
10
50
38
44
40
48
12
30
32

34
10
50
38
44
40
48
12
30

34
40
50
38
10
44
48
12
30

VERTICAL CARTON LOADING PROCESS AND SYSTEM FOR CLIPS OF A STACKED SHEET MATERIAL

BACKGROUND OF THE INVENTION

Various sheet materials, such as stacked tissue products or textile products are typically sold in flat, rectangular-shaped cartons or in upright, cubed-shaped cartons. In order to package the sheet materials, such as facial tissues, various continuous cartoning machines have been developed in the past. Many of these machines, for instance, include moving conveyors in which stacks or "clips" of the sheet material are moved in parallel with a column of cartons. A device is then used to push the clips of sheet material horizontally into the cartons.

For example, for rectangular-shaped cartons, the clips of sheet material are typically loaded into the cartons in a flat configuration. For cubed-shaped cartons, on the other hand, the clips of sheet materials are typically folded and then loaded into the cartons. Once loaded into the cartons, the cartons are then sealed and shipped for purchase and use by consumers.

Because the above described machines load the clips of sheet material horizontally into the cartons, the shape of the cartons are somewhat limited to having a basic box-like shape. Complex-shaped cartons, including cartons having curved surfaces are not well suited for being used in such machines. The machines are simply not configured to process complex shapes, especially at high speeds.

Non-rectangular shaped dispensers or dispensers with a complex shape, however, may provide various benefits and advantages to a manufacturer depending upon the particular product being sold. Such dispensers, for instance, may be considered by consumers to improve the aesthetics of the product, especially facial tissue products where dispensers are sometimes displayed in plain view around a person's home. Irregular-shaped dispensers may also be found appealing and fanciful to children, thus encouraging them to use the product for improving their hygiene habits. Unique and stylistic-shaped dispensers may also allow manufacturers to better differentiate their products from the products of others and to otherwise indicate quality.

In view of the above, a need currently exists for an improved continuous motion packaging system that is capable of packaging clips of a sheet material into a dispenser. More particularly, a need currently exists for a system and process that is capable of loading clips of a sheet material into non-rectangular shaped dispensers, such as dispensers with curved walls or with any other suitable complex shape.

SUMMARY OF THE INVENTION

In general, the present disclosure is directed to a system and process for packaging clips of a sheet material. The sheet material may comprise, for instance, any suitable tissue product or textile product. For instance, the sheet material may comprise a tissue product, such as a facial tissue, a stacked bath tissue product, premoistened wipers, industrial wipers, napkins, stacked paper towels, other various wipers, and the like. In other embodiments, the sheet material may comprise stacked layers of nonwoven webs, such as meltblown webs, spunbond webs, hydroentangled webs, webs containing a mixture of cellulose fibers and synthetic fibers, and laminates thereof. The clips may contain the sheet material as individual sheets that can be interfolded together or as a folded continuous sheet that includes perforation lines for separating one sheet from the stack.

The system and process of the present disclosure generally positions and folds clips horizontally and then loads the clips vertically into the top of a dispenser. By loading the clips vertically into the top of the dispenser, the process and system is well suited to handling dispensers having a complex shape, such as dispensers with rounded sides or any other suitable shape that is non-rectangular. Of particular advantage, the packaging system can also be used in conjunction with standard horizontal cartoning machines for also horizontally loading clips of a sheet material into dispensers.

In one particular embodiment, for instance, the present disclosure is directed to a process for packaging clips of a sheet material that includes the steps of conveying a plurality of clips of a sheet material in a downstream direction and conveying a plurality of containers, such as dispensers, in a downstream direction. The containers are moved adjacent to the clips of the sheet material. A plurality of vertical buckets are also conveyed in the downstream direction above the plurality of containers.

In accordance with the present disclosure, each clip is horizontally transferred into a corresponding vertical bucket. The clips are then transferred from the vertical bucket downward into a corresponding container, such as a sheet dispenser. Once loaded into the dispenser, the top of the dispenser can be sealed and shipped to any suitable location, such as to a retail store for sale to consumers.

In one embodiment, the process can further include the step of folding the clips of sheet material prior to loading the clips into the vertical buckets. For instance, the clips can be folded into an upsidedown U-shape and then transferred into the vertical buckets for loading into the dispensers. If necessary, the dispensers can be positioned below the vertical buckets while the clips are being transferred into the vertical buckets. The dispensers can be positioned below the vertical buckets, for instance, by a moving guide head that moves in conjunction with the vertical buckets.

The process can further include the step of rotating each vertical bucket after the vertical bucket has been loaded with a clip of sheet material. For instance, the buckets can be rotated 90 degrees. Once the buckets are rotated, the clips are then transferred into the dispensers. The clips may be rotated in order to properly position the clips within the dispensers.

In one embodiment, the clips can be transferred from the vertical buckets into transfer buckets. The transfer buckets can be conveyed further downstream after being loaded with the clips. A plurality of dispensers can be conveyed in the downstream direction adjacent to the loaded transfer buckets. In this embodiment, each clip can then be horizontally transferred from one of the transfer buckets and into a corresponding dispenser. Thus, the process can be easily modified for loading dispensers from the side as opposed to from the top.

In addition to a process for packaging clips of a sheet material, the present disclosure is also directed to a system for carrying out the process. The system can include, for instance, a clip transporting conveyor configured to transport a plurality of clips of a sheet material in a downstream direction. A container transporting conveyor can be configured to transport a plurality of containers, such as dispensers for the sheet material, also in the downstream direction. The container transporting conveyor may be positioned so that the containers move adjacent to the plurality of clips.

The system can further include a vertical bucket conveyor configured to transport a plurality of vertical buckets in the downstream direction. The vertical buckets can be suspended above the plurality of containers located on the container transporting conveyor. A horizontal pushing assembly comprising at least one transverse pushing device can be positioned to transversely move clips of the sheet material being transported on the clip transporting conveyor into corresponding vertical buckets moving on the vertical bucket conveyor.

A vertical pushing assembly may also be included in the system comprising at least one vertical pushing device. The vertical pushing device is positioned to move downwards through the vertical buckets for transferring a clip of sheet material from the vertical buckets into a corresponding container on the container transporting conveyor. For instance, as described above, the container may comprise a dispenser for the sheet material. The container transporting conveyor may include a moving guide head that is configured to engage a dispenser moving on the conveyor and to position the dispenser below a corresponding vertical bucket. The guide head, for instance, may have an engaging surface that has a shape that mates with a shape of the dispenser moving on the container transporting conveyor.

In one embodiment, each vertical bucket on the vertical bucket conveyor can be placed in operative association with a corresponding vertical pushing device. The vertical pushing devices can move along a cam track that causes the devices to extend through the vertical buckets for transferring the clips of sheet material from the vertical buckets into the dispensers moving on the container transporting conveyor.

The clips of sheet material can be loaded into the dispensers in a flat configuration or in a folded configuration. If the clips are to be folded, the system can include a clip folding device positioned in operative association with the horizontal pushing assembly. For example, the horizontal pushing assembly may comprise a plurality of transverse pushing devices while the clip folding device comprises a corresponding plurality of folding trays. The transverse pushing devices may be configured to move along a cam track that causes the devices to extend through one of the corresponding folding trays for folding and transferring a clip of sheet material into the vertical buckets.

Other features and aspects of the present disclosure are discussed in greater detail below.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

Figure 1:
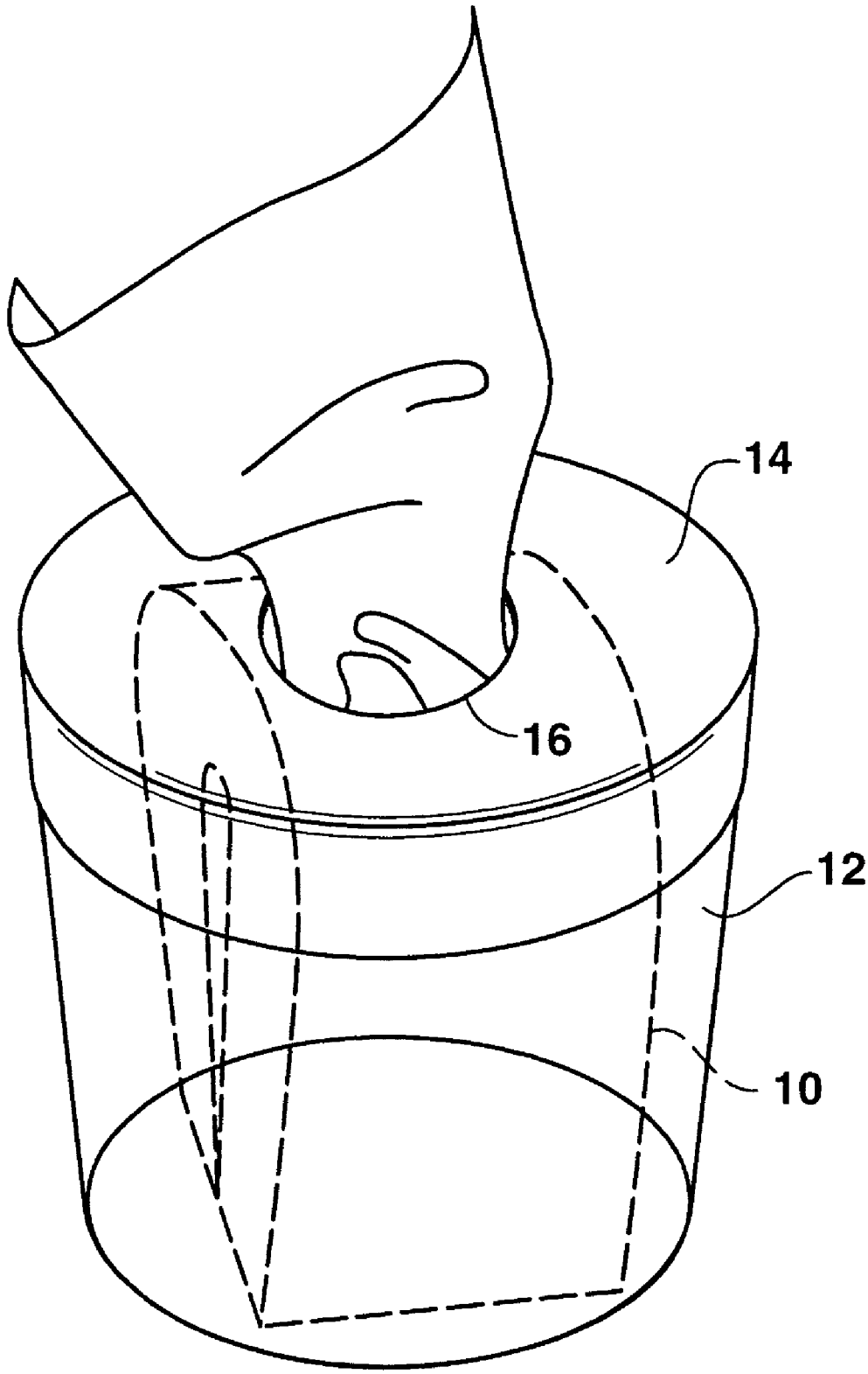
FIG. 1 is a perspective view of one embodiment of a sheet material shown being dispensed from a dispenser having a rounded configuration.

Repeat use of reference characters in the present specification and drawings is intended to represent the same or analogous features or elements of the present invention.

DEFINITIONS

As used herein, "sheet material" is a flexible substrate, which is useful for household chores, cleaning, personal care, healthcare, food wrapping, and cosmetic application or removal. Non-limiting examples of suitable sheet materials that may be packaged in accordance with the present disclosure include nonwoven substrates, woven substrates, hydroentangled substrates, air-entangled substrates, single or multi-ply paper substrates comprising cellulose such as tissue paper, toilet paper, facial tissue, or paper towels, airlaid substrates, waxed paper substrates, coform substrates comprising cellulose fibers and polymer fibers, premoistened substrates such as wet wipes, moist cleaning wipes, moist toilet paper, and baby wipes, film or plastic substrates such as those used to wrap food, and laminated substrates of two or more layers of any of the preceding substrates.

As used herein, the term "horizontal" generally refers to a direction or plane that is parallel to or substantially parallel to the horizon, while the term "vertical" as used herein means a direction or plane that is perpendicular to the horizon or substantially perpendicular to the horizon.

DETAILED DESCRIPTION

It is to be understood by one of ordinary skill in the art that the present discussion is a description of exemplary embodiments only, and is not intended as limiting the broader aspects of the present invention.

Various sheet materials, especially facial tissues, are currently sold in flat, rectangular-shaped or upright, cube-shaped cartons. Most cartoning machines for these products fill the cartons by pushing the stack of sheets horizontally into one side of the carton. Since complex shaped cartons, such as cartons with curved side walls, can be difficult to orient and convey on their sides, such cartoning machines are not well suited to loading these types of cartons.

The present disclosure, on the other hand, is generally directed to a system and process for packaging sheet materials in which a stack or clip of the sheet materials can be loaded into a dispenser vertically, through the top of the dispenser. In this manner, the system and process of the present disclosure is well suited to loading clips of a sheet material into a dispenser having any suitable shape. The dispenser, for instance, may have a complex and stylized shape. For example, in one particular embodiment, as shown in FIG. 1, the system and process of the present invention may be used to load a clip of sheet materials 10, such as facial tissues, into a dispenser 12 having a circular or oval shape.

As shown in FIG. 1, the system and process is also equipped to fold the clip of sheet materials 10 prior to loading the clip into the dispenser 12. For example, in one embodiment, the clip of sheet material 10 can be folded in half to form an "upsidedown U-shape" within the dispenser 12. Once loaded into the dispenser 12, the top of the dispenser is sealed. As shown in FIG. 1, a top 14 of the dispenser 12 may be configured to dispense the sheet materials one at a time, such as through an opening 16. Of particular advantage, the system and process provides the potential to seal or apply a top or lid directly to the dispenser 12 in-line with the packaging process.

Also of particular advantage, the system and the process of the present disclosure can also be configured to load a clip of sheet materials into dispensers horizontally as well. For instance, the packaging system of the present disclosure may be placed in series with a horizontal packaging machine for loading the dispensers with a clip of tissues in a traditional side-loaded manner.

In general, the continuous motion packaging system of the present disclosure indexes individual dispensers in synchronization with a stream of clips of a sheet material such that each clip entering the system is loaded into a corresponding dispenser. The system generally includes a first stream or conveyor that carries the clips of sheet material along the processing line, a second stream or conveyor that conveys the dispensers along the processing line and a third stream or conveyor that carries a plurality of vertical buckets along the processing line. The vertical buckets travel along the processing line above the stream of dispensers.

A pusher mechanism that can be cam-operated pushes the clips of sheet material horizontally into one of the corresponding vertical buckets. If desired, a folding device may be present that also folds the clip of sheet material as the clip is loaded into the vertical bucket. Once loaded into the vertical bucket, the clip of sheet material is then transferred from the vertical bucket downward into a corresponding dispenser. If desired, the system can also be configured to rotate the clip of sheet materials in the vertical bucket prior to transferring the clip into the dispenser.

Since the travel of the vertical buckets is above the dispensers, the path of the dispenser and the path of the clips of tissue material can be linear to facilitate accurate control of the process.

Figure 2:
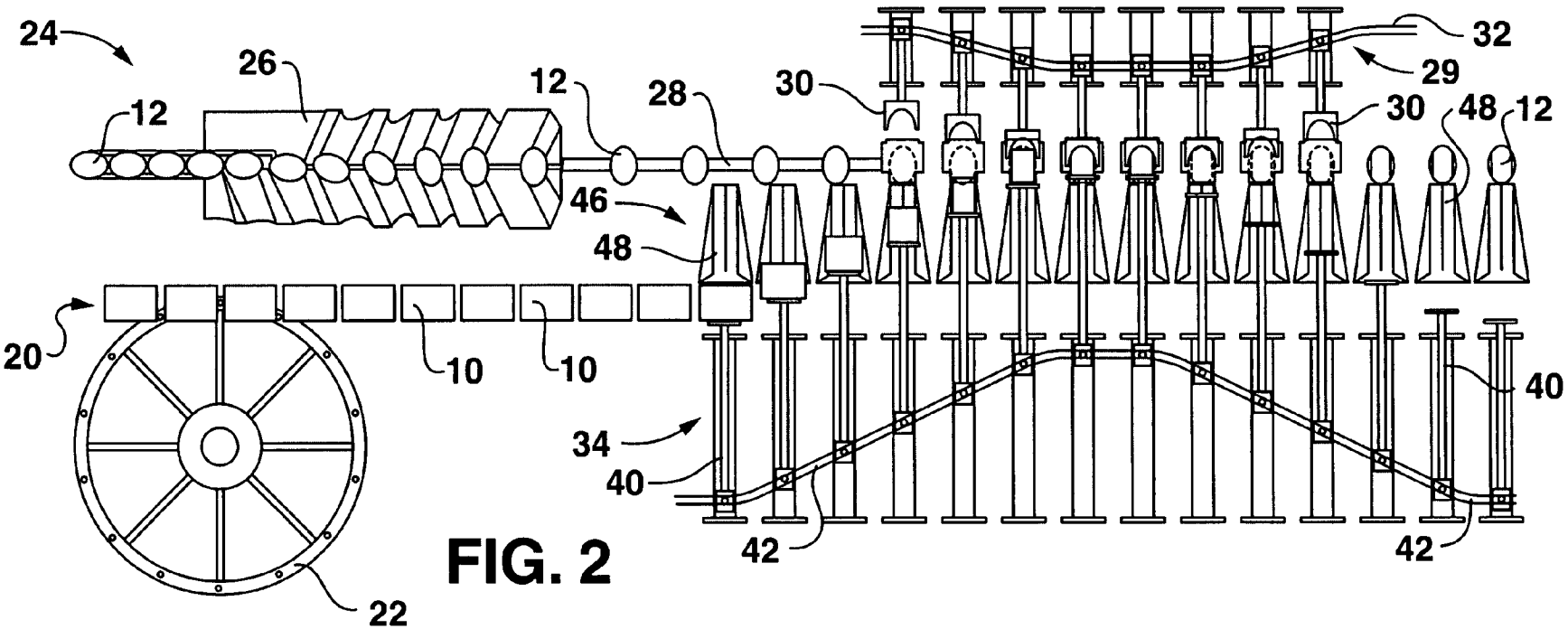
FIG. 2 is a plan view of one embodiment of a system for packaging clips of a sheet material.
Figure 3:
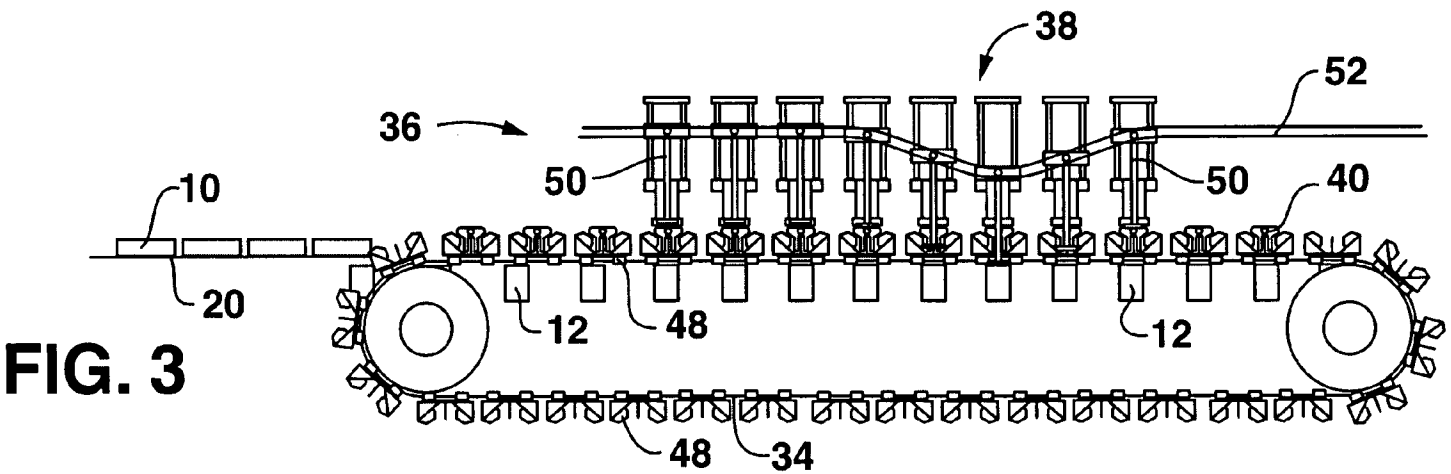
FIG. 3 is a side view of the embodiment illustrated in FIG. 2.

Referring to FIGS. 2 and 3, one exemplary embodiment of a sheet material packaging system made in accordance with the present disclosure is illustrated. Specifically, FIG. 2 represents a top view or plan view of the system, while FIG. 3 is a side view of the system illustrated in FIG. 2. As shown, the system includes a first conveyor 20 for conveying a plurality of clips of a sheet material 10. The clip transporting conveyor 20 can comprise any suitable conveying device and is not intended to be limited by the particular embodiment shown in the figures.

In FIG. 2, the clip transporting conveyor 20 includes a conveying wheel 22. The conveying wheel 22 is for receiving formed stacks of the sheet material 10. The stacks or clips 10, for instance, may comprise a certain number of individual sheets that are stacked on top of one another, interfolded together or detachably connected together by, for instance, perforation lines. The clips 10 can be formed in any suitable process as is well known in the art. As the clips 10 enter the conveying wheel 22, the clips 10 are spaced a desired amount apart and can follow a curved path such as a 90 degree turn as the clips enter the clip transporting conveyor 20.

As shown in FIG. 3, the clips 10 then travel downstream on the conveyor 20 into the processing line. If desired, any suitable holding device or bucket may be placed on the conveyor 20 for maintaining the clips 10 in the proper spacing and in the proper alignment.

As shown in FIG. 2, the system also includes a container transporting conveyor 24 that, in this embodiment, conveys a plurality of dispensers 12 for the clips of sheet material 10. As illustrated, a column of dispensers 12 are first fed to a dispenser spacing device 26. The dispenser spacing device can rotate and space the dispensers 12 apart a desired distance. For example, the dispenser spacing device 26 may comprise a screw conveyor as shown in FIG. 2 that conveys, spaces and rotates the dispensers 12.

From the dispenser spacing device 26, the dispensers 12 are further conveyed on a conveyor 28 downstream into the processing line.

As shown in FIGS. 2 and 3, the dispensers 12 have a non-rectangular shape. In particular, the dispensers 12 have curved side walls and thus have a cross section in the shape of an oval. In general, any shaped dispenser may be used in the system and process of the present disclosure. For instance, if desired, conventional rectangular-shaped or cube-shaped dispensers may be processed as well.

As shown in FIG. 2, the container transporting conveyor 28 positions containers in alignment with the moving guide head assembly 29. The moving guide head assembly 29 includes a plurality of guide heads 30 that are configured to engage each dispenser 12 and to hold the dispenser in a particular position while the dispenser is being loaded with the clips of sheet material 10. In particular, each guide head 30 includes an engaging surface that has a shape that mates with the shape of a corresponding dispenser 12. Thus, as will be described in more detail below, the position of each dispenser 12 is controlled for ensuring that the clips of sheet material 10 are positioned within the dispensers in a correct location.

The moving guide head assembly 29 can form an endless loop and the guide heads 30 can move at substantially the same speed as the dispensers 12. In order to engage each dispenser, the guide heads 30 can move along a cam track 32. As shown in FIG. 2, the cam track 32 moves the guide heads 30 into an engaging position with the dispensers 12 as the dispensers are being loaded with the clip of sheet material 10.

As shown in FIGS. 2 and 3, the system further includes a horizontal pushing assembly 34 that is located along the clip transporting conveyor 20. The system further includes a vertical bucket conveyor 36 as shown in FIG. 3 that is configured to transport a plurality of vertical buckets generally parallel to and above the stream of dispensers 12. As also shown in FIG. 3, the vertical bucket conveyor 36 includes a vertical pushing assembly 38.

Figure 4A:
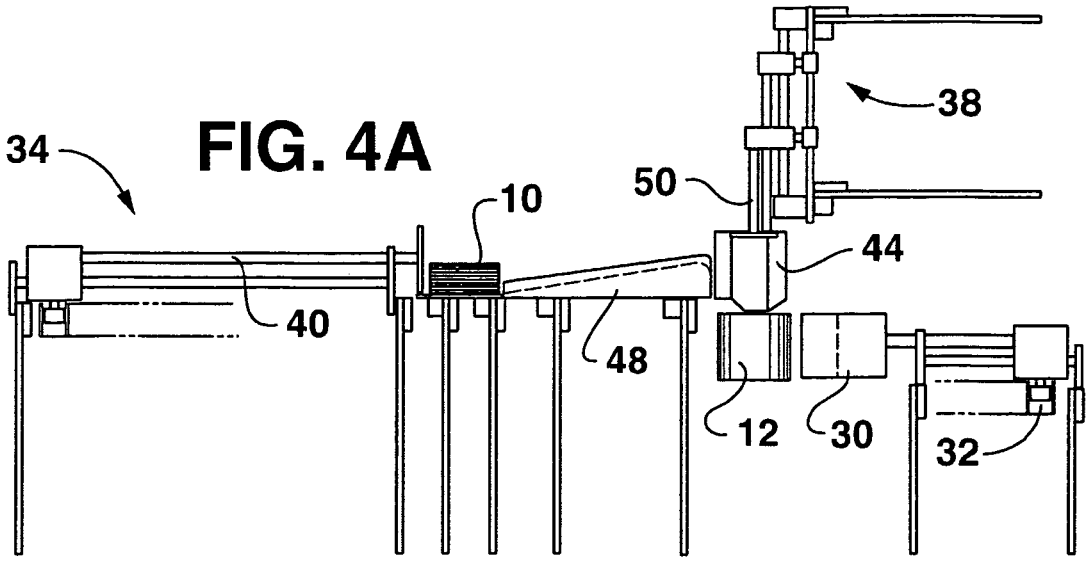
FIGS. 4A through 4E are side views illustrating a clip of a sheet material being folded, transferred into a vertical bucket, and then transferred into a dispenser in accordance with one embodiment of the present disclosure.

In order to load the clips of sheet material 10 into the dispensers 12, the clips of sheet material 10 travel along the clip transporting conveyor 20 and come into engagement with the horizontal pushing assembly 34. As shown in FIG. 3, the horizontal pushing assembly 34 can be mounted on a continuous track or conveyor. The horizontal pushing assembly 34 comprises a plurality of transverse pushing devices 40. The transverse pushing devices 40 follow a cam track 42 as shown in FIG. 2. As the clips of the sheet material 10 travel along the clip transporting conveyor 20, the transverse pushing devices 40 engage each clip 10 and move each clip 10 horizontally across the conveying lines into a corresponding vertical bucket on the vertical bucket conveyor 36. For example, one of the vertical buckets 44 is illustrated in FIG. 4A. As shown, the vertical bucket 44 is positioned over a corresponding dispenser 12.

In accordance with the present disclosure, the clips of the sheet material 10 can be loaded into a dispenser 12 in a flat configuration. Alternatively, the clips of the sheet material 10 can be folded prior to being loaded into the dispensers. For example, as shown in FIG. 2, the system can further include a folding device 46 that, in this embodiment, comprises a plurality of folding trays 48. As illustrated, for each transverse pushing device 40 there is a corresponding folding tray 48. As shown in FIG. 3, each transverse pushing device 40 and corresponding folding tray 48 can be positioned on an endless conveyor.

Referring to FIG. 2, as the clips of sheet material 10 are being transferred by the transverse pushing devices 40, each clip travels through a folding tray 48 that causes the clip to fold prior to being placed into a vertical bucket 44.

Once a clip of sheet material 10 is transferred into a vertical bucket 44, the clip is then subsequently transferred into a corresponding dispenser 12 through the top of the dispenser. More particularly, the vertical pushing assembly 38 is configured to move the clips 10 from the vertical buckets 44 and into the dispensers 12. As shown in FIG. 3, for instance, the vertical pushing assembly 38 comprises a plurality of vertical pushing devices 50 that travel along a cam track 52. The cam track 52 causes the vertical pushing devices 50 to extend through the vertical buckets 44 for transferring the clips into the dispensers 12 as will be described in more detail below.

The process for transferring the clips of sheet material 10 from the clip transporting conveyor 20 and into the vertical buckets 44 for transfer into the dispensers 12 is more particularly illustrated in FIGS. 4A through 4E and in FIGS. 5A through 5D. Specifically, FIGS. 4A through 4E are sequential side views of the process, while FIGS. 5A through 5D are sequential perspective views of the process.

Figure 5A:
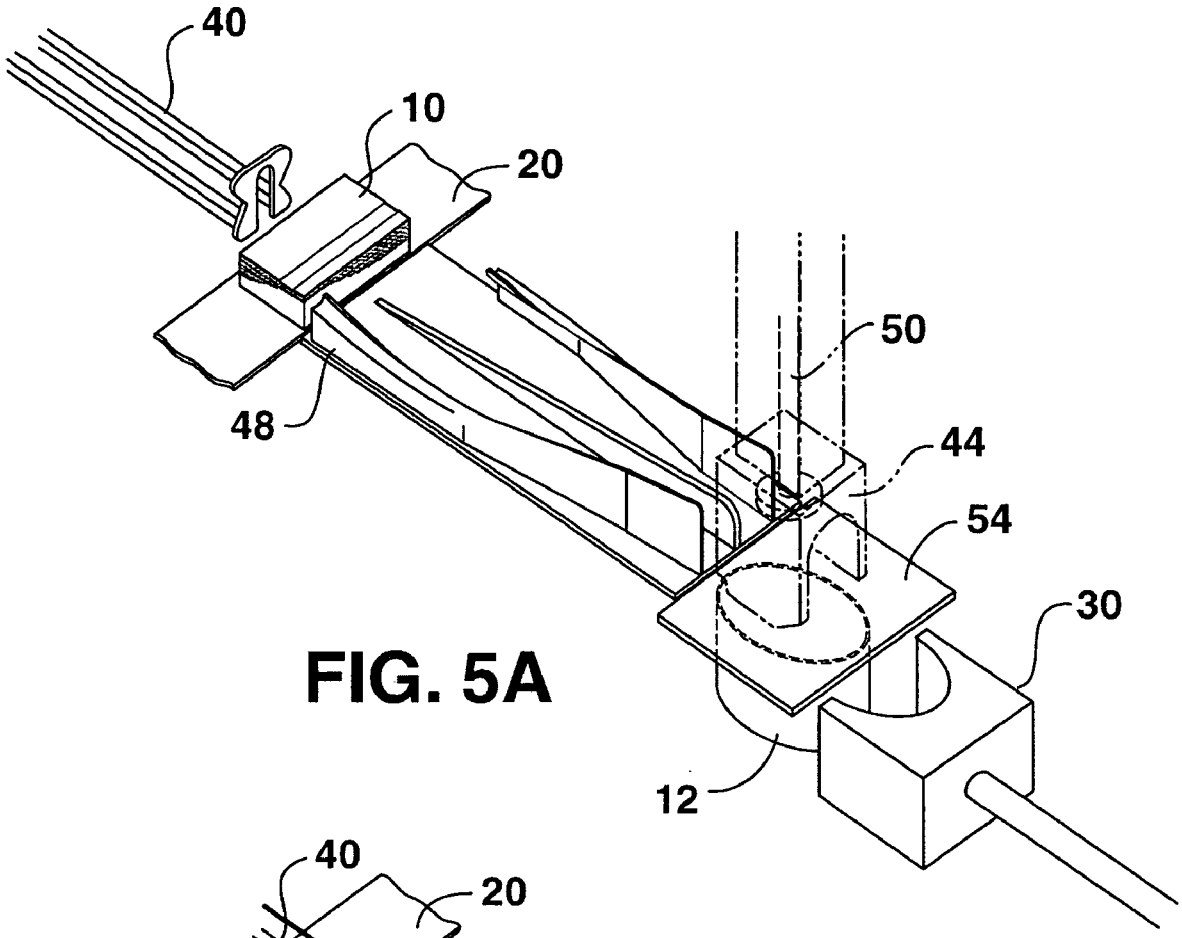
FIGS. 5A through 5D are perspective views of the process and system illustrated in FIGS. 4A through 4E.

As shown in FIGS. 4A and 5A, a clip of sheet material 10 travels along the clip transporting conveyor 20 and is engaged by a transverse pushing device 40 of the horizontal pushing assembly 34. During the process, the transverse pushing device 40, the clip transporting conveyor 20, the folding trays 48, the dispensers 12, the vertical buckets 44, and the guide heads 30 can move downstream at approximately the same speed. If desired, as shown in FIG. 5A, the system may include a stationary slide plate 54 positioned in between the vertical buckets 44 and the dispenser 12. The slide plate 54 may assist in loading the clips of sheet material 10 into the vertical bucket 44 prior to transferring the clips 10 into the dispensers 12. Thus, the stationary plate 54 can comprise a structure that the transverse pushing device 40, the folding tray 48 and the vertical bucket 44 moves past as the clip of sheet material 10 is transferred into the vertical bucket 44. The stationary plate 54, however, may not be needed in some applications.

Figure 4B:
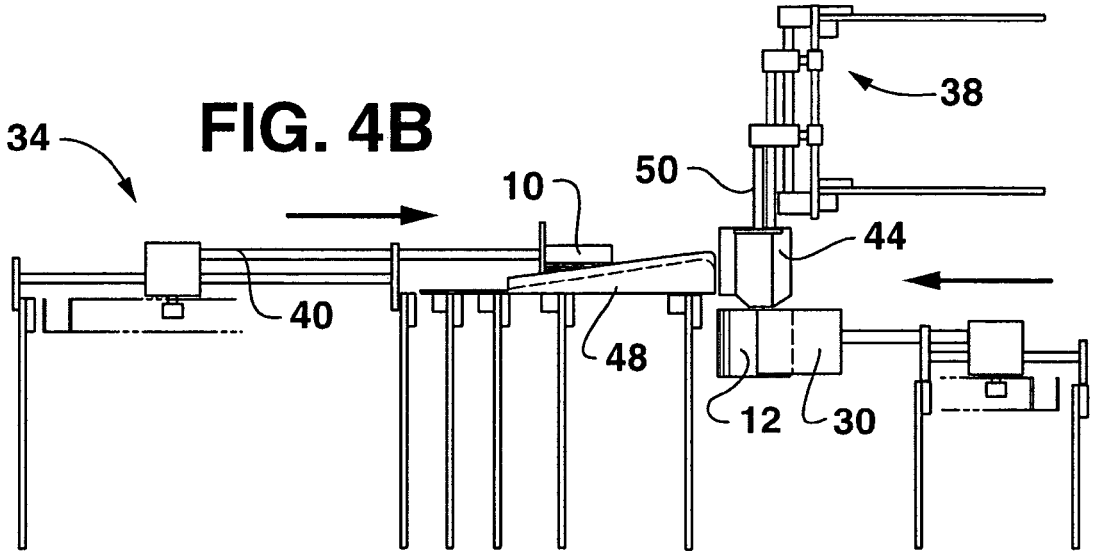
Figure 5B:
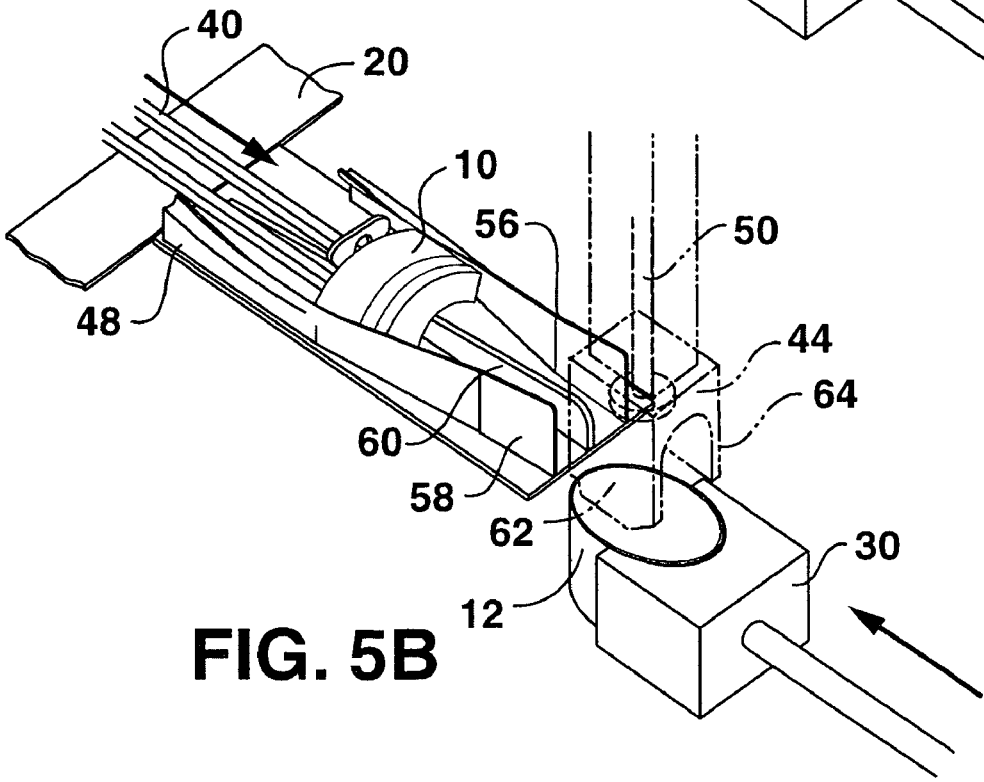

As shown by comparing FIGS. 4A and 5A with FIGS. 4B and 5B, the clip of sheet material 10 during the process is engaged by the transverse pushing device 40 which pushes the clip of sheet material, in this embodiment, through the folding tray 48. Simultaneously, the guide head 30 engages the dispenser 12 for ensuring that the dispenser 12 is in the correct position. In this embodiment, the guide head 30 includes a curved engaging surface that mates with the shape of the dispenser 12. As can be appreciated, the guide heads 30 can be configured to be quickly changed when changing the shape or configuration of the dispenser 12 or for other such grade changes.

As stated above, the system of the present disclosure can be configured to load the clips of sheet material 10 into a dispenser in a flat configuration. Alternatively, the folding device can be included in the system for folding the clips during the process. Any suitable folding device may be used depending upon the type of fold that is desired. In the embodiments shown in FIGS. 4 and 5, the folding device comprises a folding tray 48 that is configured to fold the clip of tissue sheets 10 in half and form an upsidedown U-shape. Once loaded into the dispenser 12, a user can access the top sheet in the clip at the apex of the upsidedown U-shape.

Figure 4C:
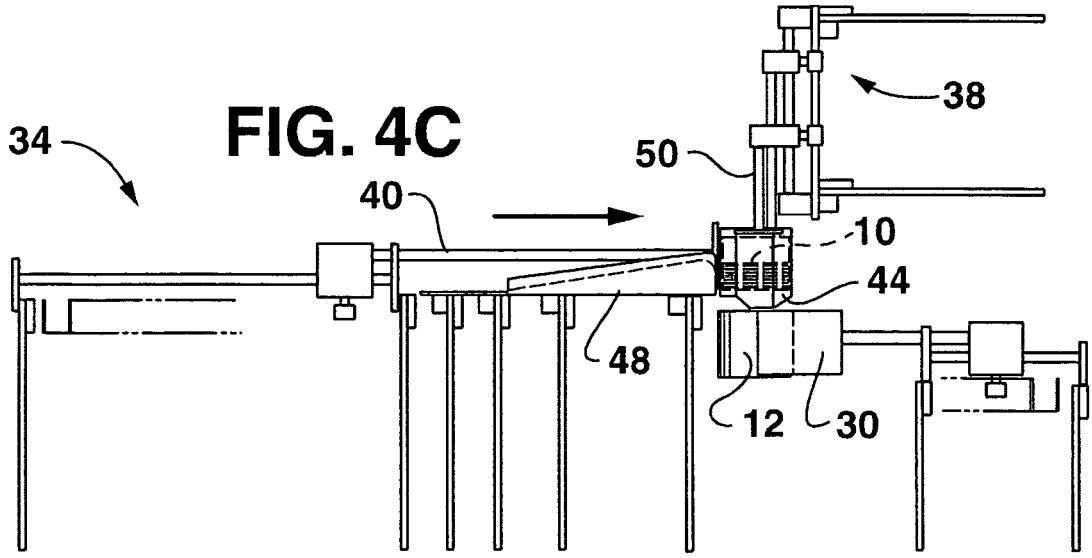
Figure 4D:
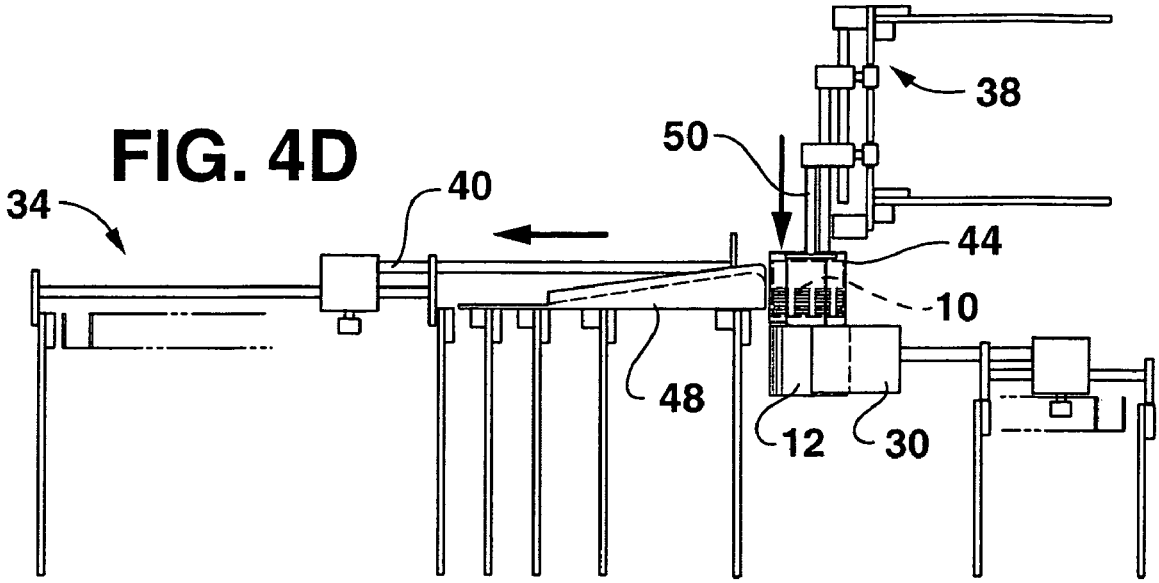
Figure 4E:
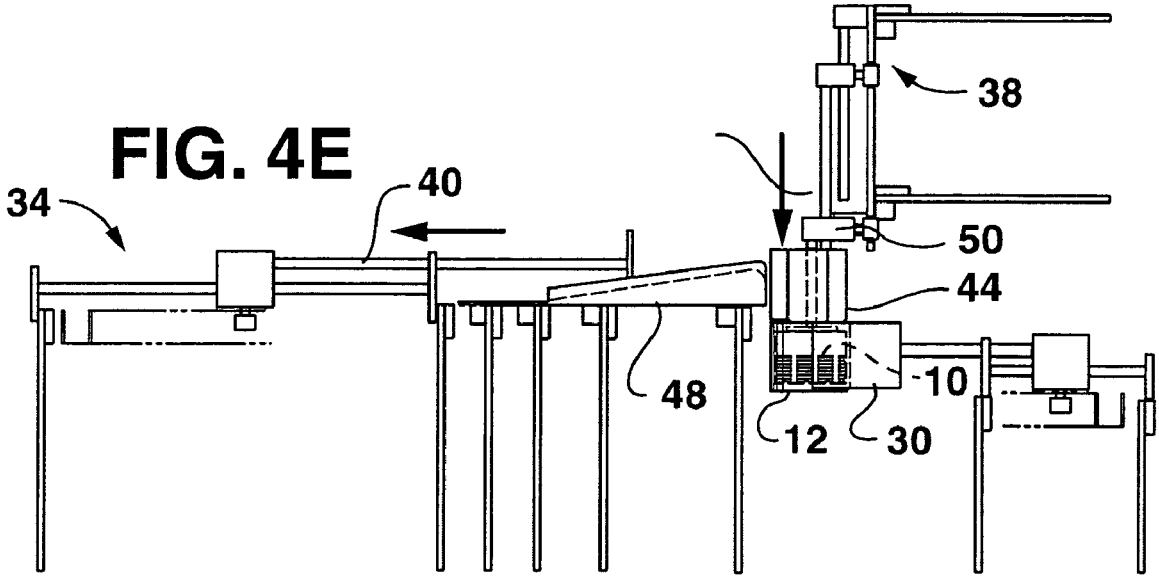
Figure 5C:
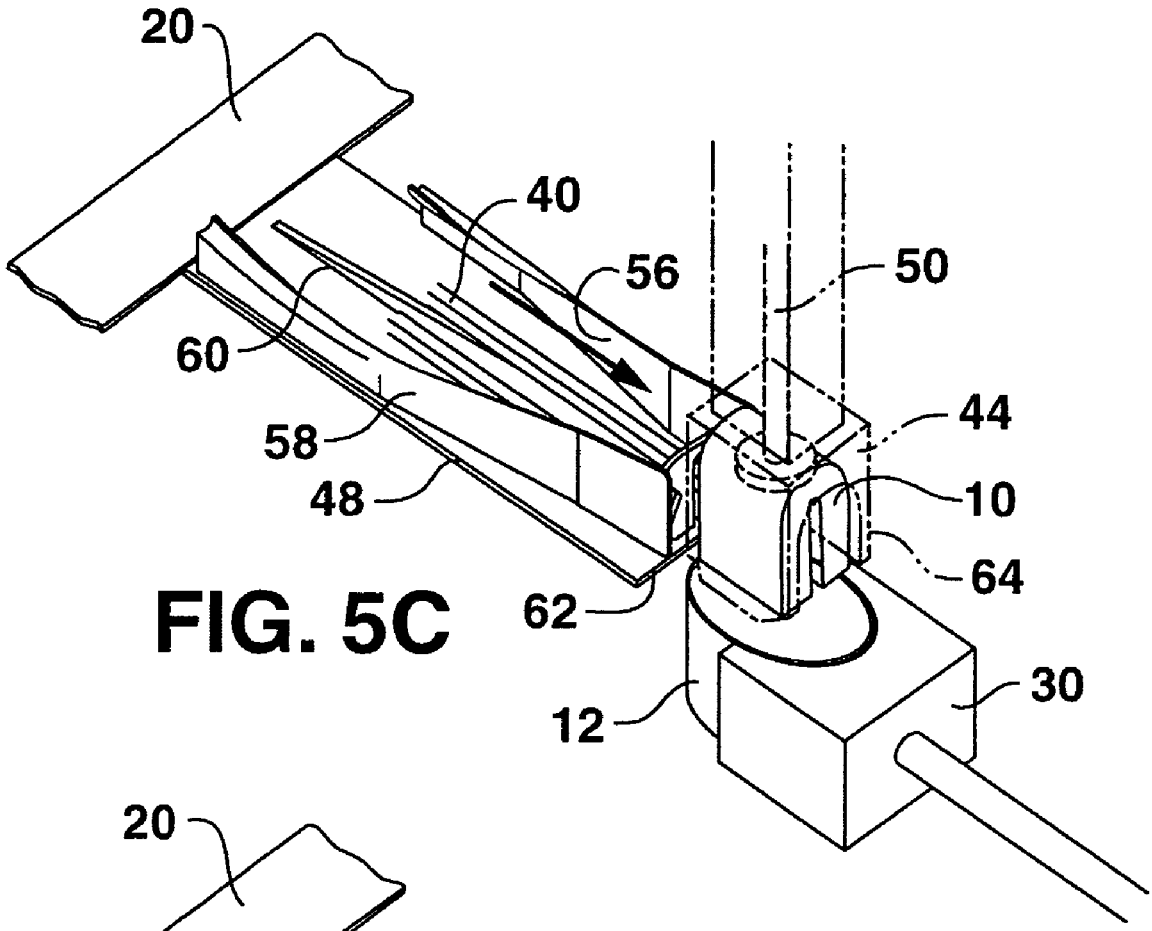
Figure 5D:
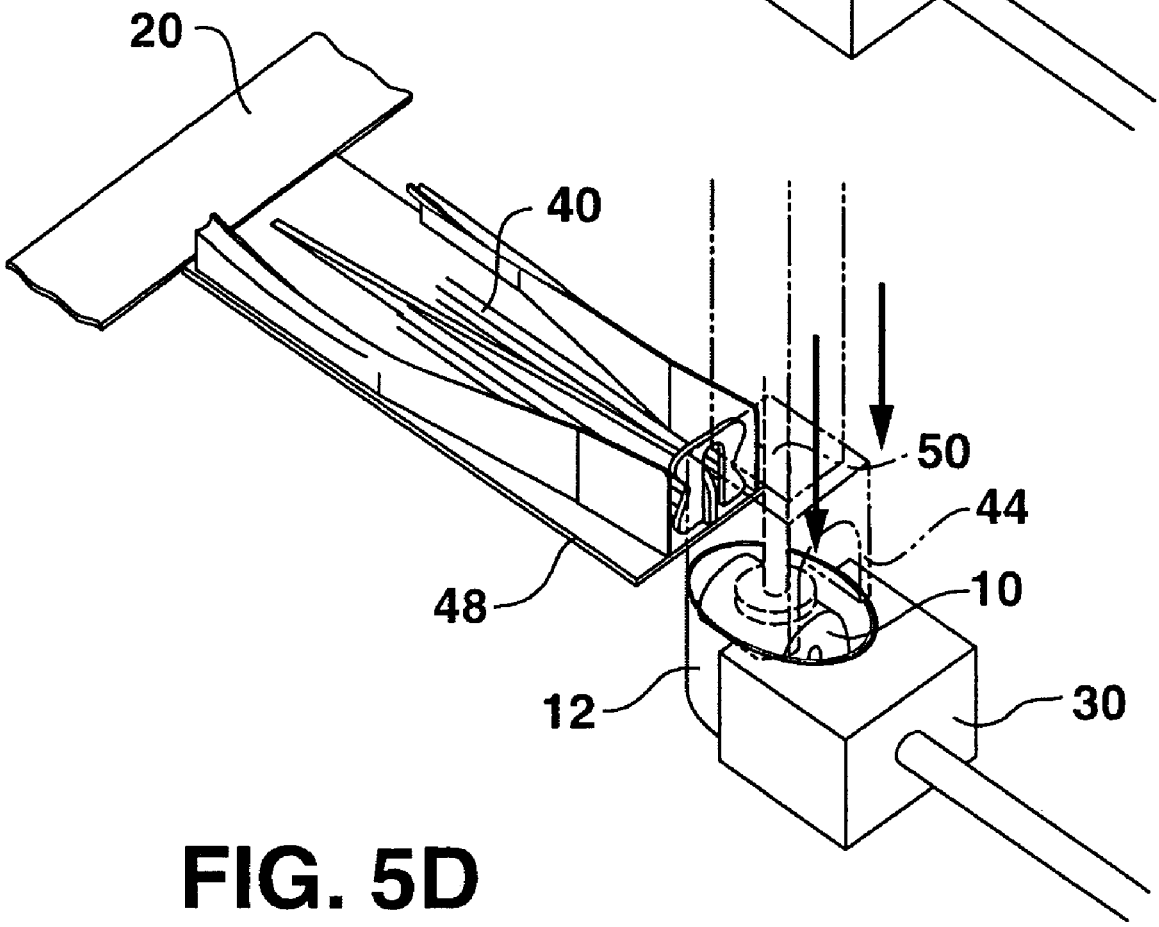

Referring particularly to FIGS. 5B and 5C, the folding tray 48, in this embodiment, comprises a pair of opposing shaped side guides 56 and 58 and an inclined center blade 60. As shown in FIG. 5B, as the clip of sheet material 10 traverses across the folding tray, the side guides 56 and 58 form a funnel as the height of the center blade 60 increases. The side guides 56 and 58 in combination with the center blade 60 cause the clip of sheet material 10 to fold around the center blade 60 as the clip 10 is loaded into the vertical bucket 44. As shown in FIG. 5C, the clip of sheet material 10 ultimately forms the upsidedown U-shape once loaded into the vertical bucket 44. The side view of this process is shown in FIGS. 4B and 4C.

As also shown in FIGS. 5B and 5C, the vertical bucket 44 includes a pair of side walls 62 and 64. The side walls 62 and 64 are spaced apart a distance sufficient to receive the folded clip of sheet material 10 as shown in FIG. 5C. In one embodiment, the side walls can be positioned so that the clip 10 forms a tension fit within the vertical bucket. In this manner, the clip 10 is retained within the vertical bucket 44 until transferred into the dispenser 12.

It should be understood, however, that the vertical bucket 44 can be designed in any suitable manner so as to retain the clip 10 of sheet material prior to being transferred to the dispenser 12. For example, in alternative embodiments, the interior walls of the vertical buckets 44 may include tabs or spring-loaded fingers that maintain the sheet material within the vertical bucket until a downward force is placed upon the clip. Also, as described in 5A, the system may include the stationary plate 54 so that tension is not required to retain the clip prior to be being transferred to the dispenser.

Referring to FIGS. 4D, 4E, 5C and 5D, once the clip 10 of sheet material is loaded into the vertical bucket 44, the transverse pushing device 40 is retracted and the vertical pushing device 50 is activated. As shown, the vertical pushing device 50 forces the clip of sheet material 10 from the vertical bucket 44 and into the dispenser 12. Optionally, the transverse pushing device 40 may remain extended as the vertical pushing device 50 is activated to aid clip guiding alignment downward into the dispenser 12.

In some embodiments, the system can be configured so that the vertical bucket 44, once loaded with the clip of sheet material 10, can move downwardly closer to the dispenser 12 during transfer of the clip into the dispenser. In addition, the vertical buckets and the horizontal pushing assembly can be raised or lowered to accommodate dispensers having various heights.

In one embodiment, the system of the present disclosure may also be configured to rotate the clip of sheet material within the vertical buckets prior to being transferred into the dispensers. It may be desirable to rotate the clip of sheet materials for various reasons. For instance, in one embodiment, instead of dispensing the folded clip from the apex of the upsidedown U-shape, it may be desirable to dispense the sheets from the side or from the end of the clip rather than from the top of the clip. Alternatively, rotating the clip allows for the clip to be accessed from the side of the dispenser if desired. Dispensing from the side of the clip may improve the fit in the carton thereby providing added capacity and improved dispensing performance.

Referring to FIG. 6 and FIGS. 7A through 7D, one embodiment of a bucket rotating device 62 is illustrated. Like reference numerals have been used to indicate the same or similar elements.

Figure 6:
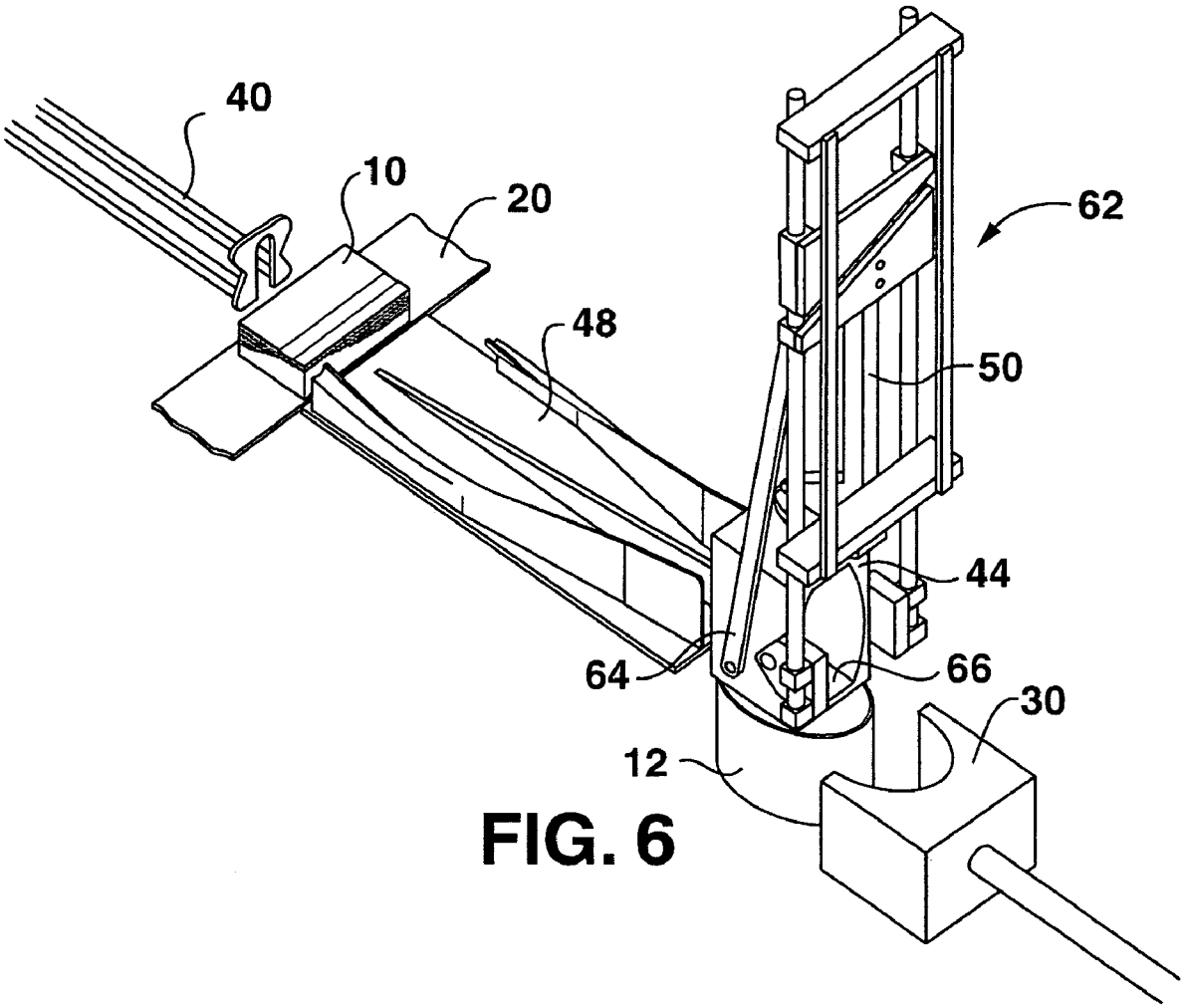
FIG. 6 is a perspective view of an alternative embodiment of a vertical bucket that may be used in the system and process of the present disclosure.

As shown in FIG. 6, in this embodiment, the vertical bucket 44 includes a bottom wall 66. The vertical bucket 44 is also in operative association with a linkage arm 64. In this embodiment, the linkage arm 64 moves up and down along a track.

The linkage arm 64 can be activated as the vertical buckets move along the cam track. If desired, however, a motor or a cylinder, such as a hydraulic or pneumatic cylinder, may be used to activate the linkage arm 64.

Figure 7A:
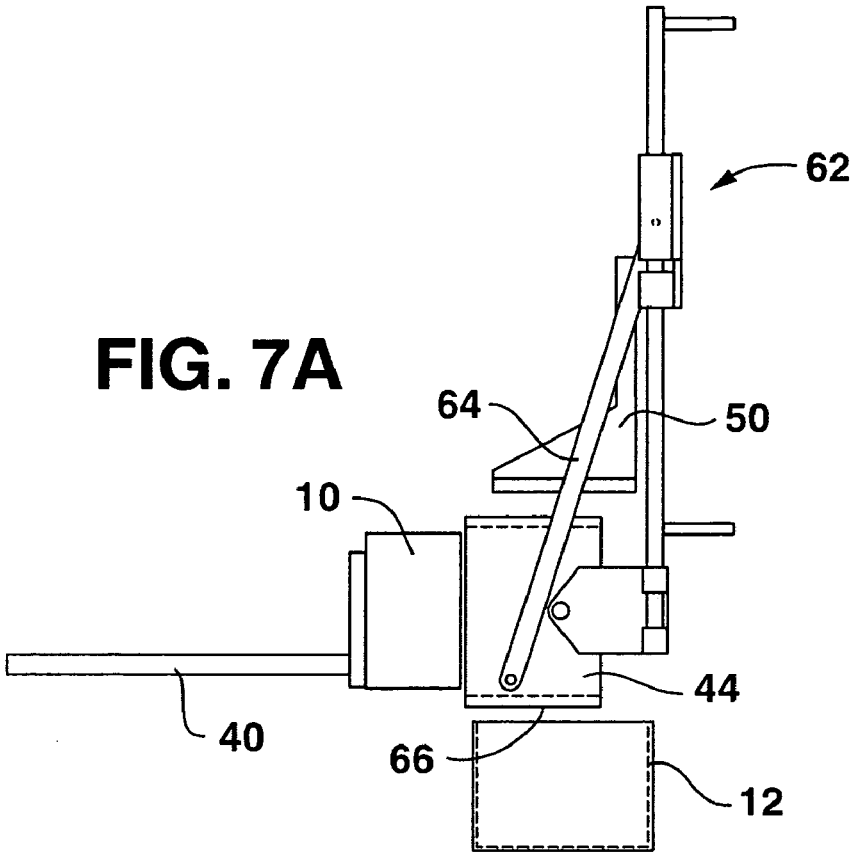
FIGS. 7A through 7D are side views of the vertical bucket shown in FIG. 6 illustrating how the vertical bucket is capable of rotating once loaded with a clip of a sheet material.
Figure 7B:
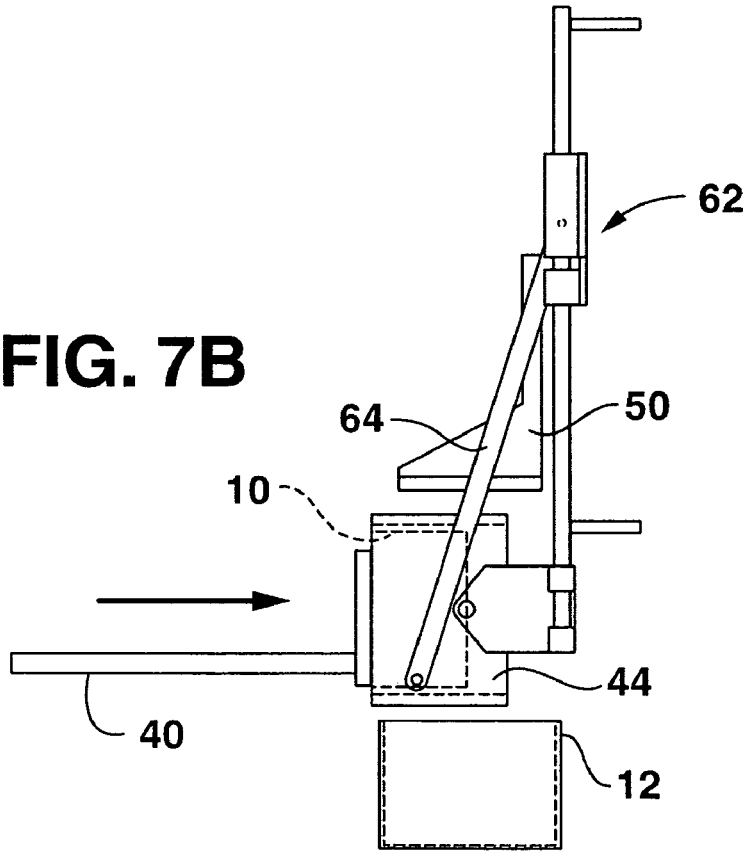
Figure 7C:
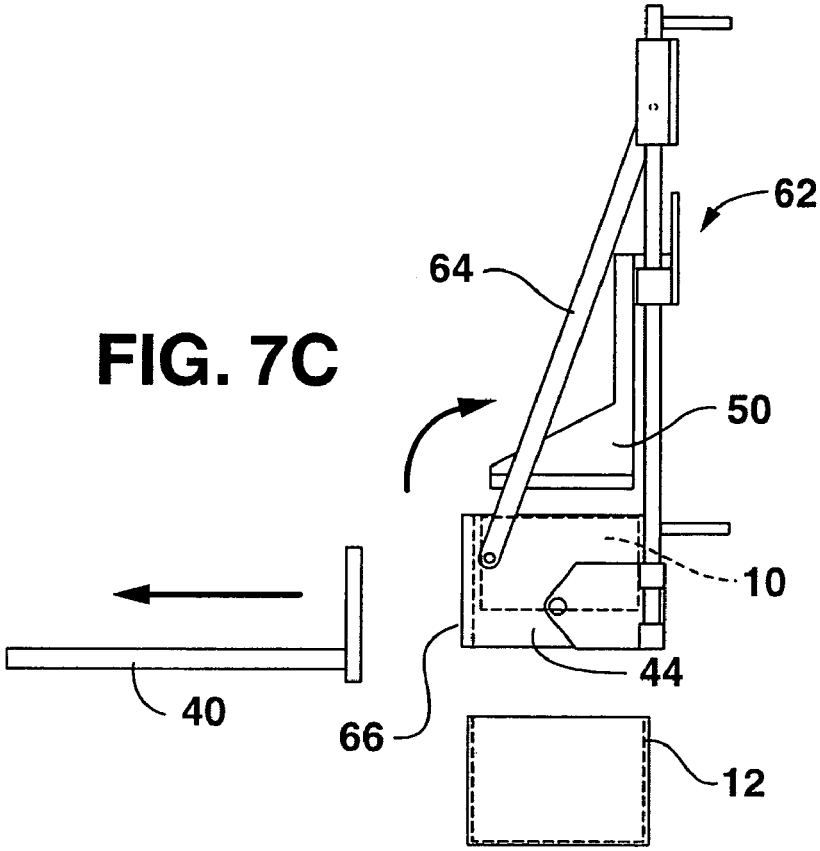
Figure 7D:
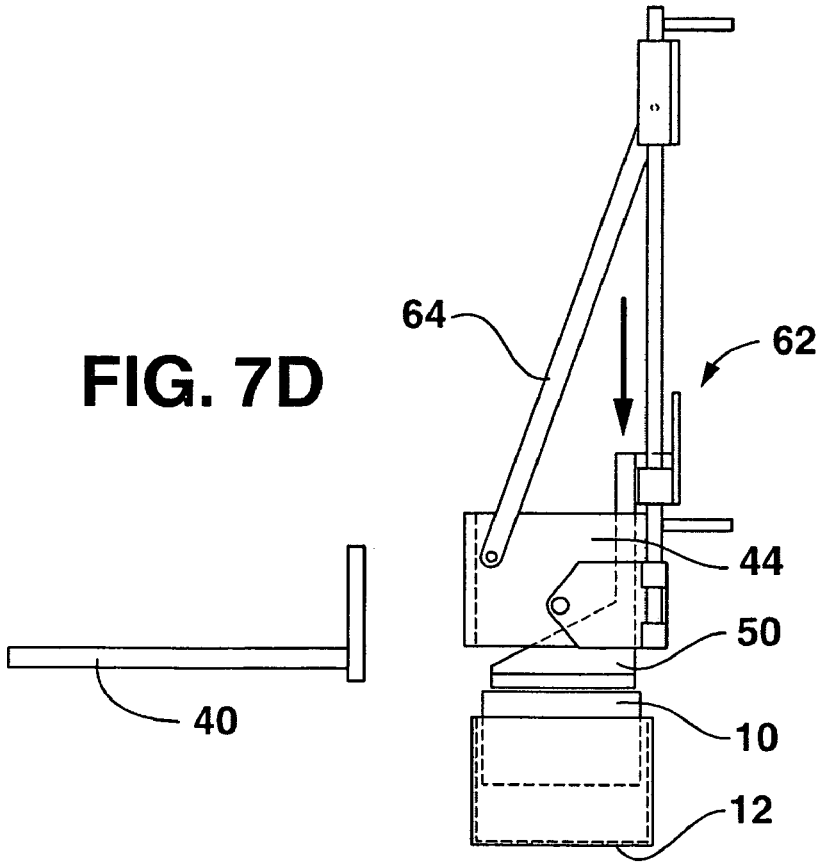

As shown in FIGS. 7A and 7B, in this embodiment, the clip of sheet material 10 is loaded into the vertical bucket 44 by the transverse pushing device 40. As shown in FIGS. 7C and 7D, once the clip 10 is located into the bucket 44, the linkage arm 64 moves up for rotating the bucket 44 90 degrees. Once rotated, the bucket 44 comes into alignment with the dispenser 12 located below the bucket. As shown in FIG. 7D, the vertical pushing device 50 is then activated for transferring the rotated clip of sheet material 10 into the dispenser 12.

Figure 8A:
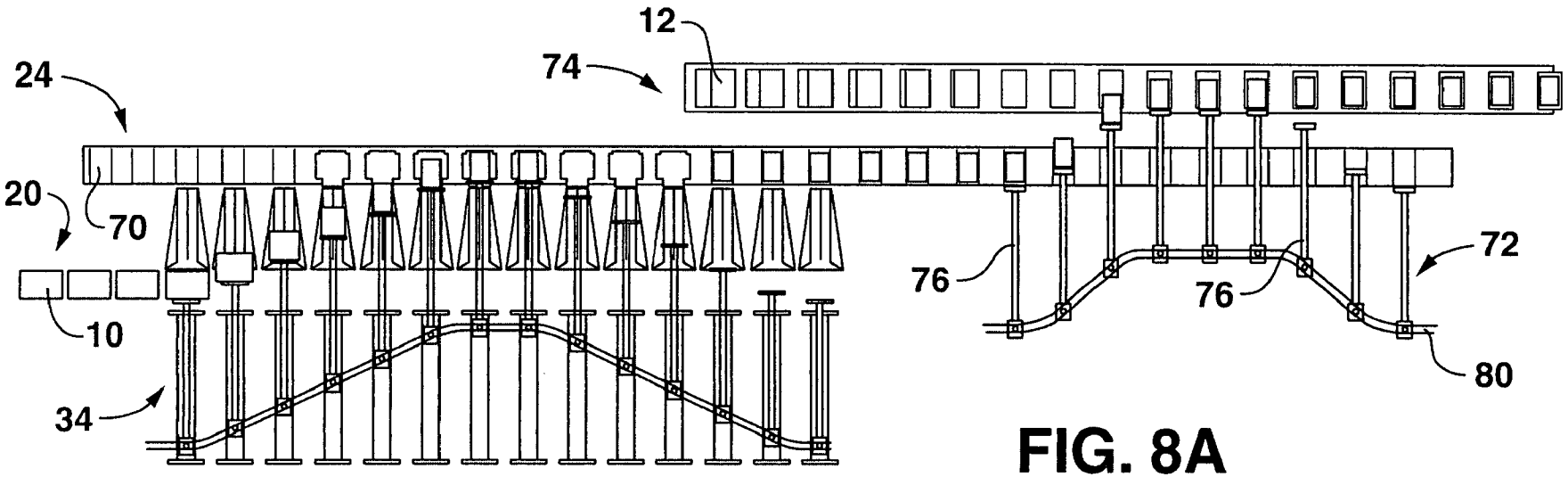
FIG. 8A is a plan view of another embodiment of a system for packaging clips of a sheet material in accordance with the present disclosure.
Figure 8B:
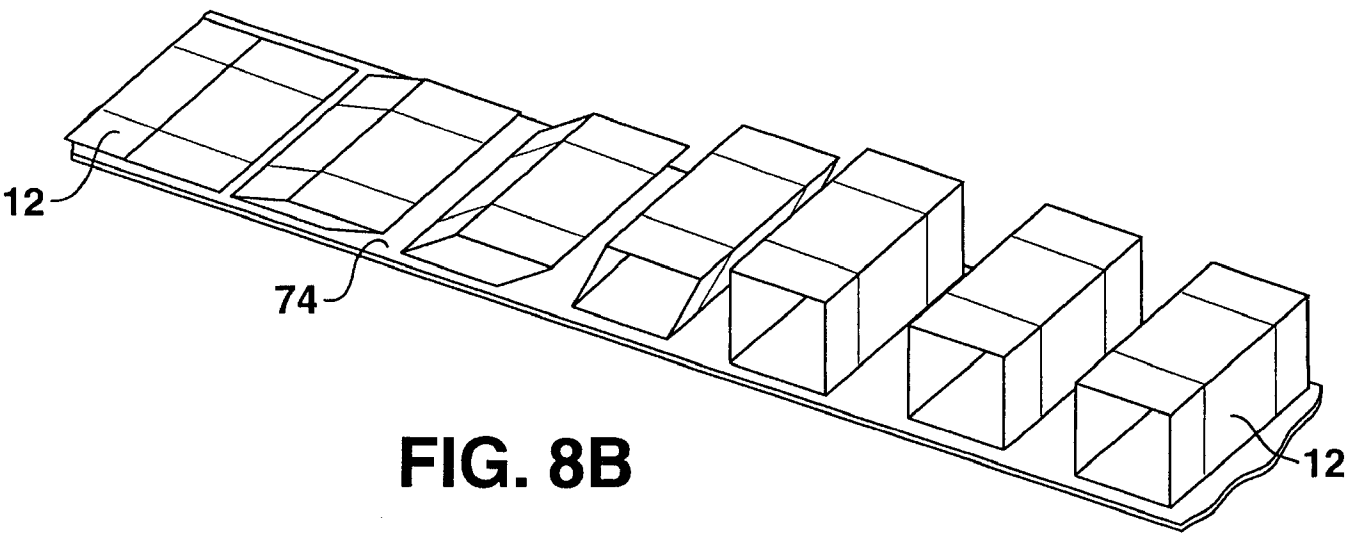
FIG. 8B is a perspective view of the plurality of dispensers that are being loaded with a clip of a sheet material in FIG. 8A.

One particular advantage to the packaging system of the present disclosure is that the system can be easily modified and used in tandem with a horizontal clip loading system so that the clips can be loaded into a dispenser from the side as opposed to the top. For example, such a system is shown in FIGS. 8A and 8B. Like reference numerals have been used to indicate the same or similar elements.

Referring to FIG. 8A, the system includes a clip transporting conveyor 20 which is similar to the conveyor 20 shown in FIG. 2. Adjacent to the clip transporting conveyor 20 is a container transporting conveyor 24. In the embodiment shown in FIG. 2, the container transporting conveyor 24 is for transporting a plurality of dispensers. In the embodiment shown in FIG. 8A, on the other hand, the container transporting conveyor 24 transports a plurality of transfer buckets 70. Not shown, the system also includes a vertical bucket conveyor such as the one illustrated in FIG. 3.

As shown in FIG. 8A, in this embodiment, the container transporting conveyor 24 extends downstream and engages a second horizontal pushing assembly 72. Further, adjacent to the container transporting conveyor 24 is a dispenser transporting conveyor 74 as also shown in FIG. 8B. The dispenser transporting conveyor 74 transports a plurality of dispensers 12 that are initially in a flat configuration and then positioned upright for loading a clip of sheet material 10.

More particularly, the clip of sheet material 10 travels along the clip transporting conveyor 20 and is then optionally folded and transferred into a plurality of vertical buckets contained on a vertical bucket conveyor as shown in FIG. 3. Next, the clip of sheet material 10 is transferred from the vertical buckets into the transfer buckets 70. A vertical pushing assembly can be used to transfer the clips into the transfer buckets through the process as shown in FIGS. 4A through 4E.

The transfer buckets 70 then travel downstream and engage the second horizontal pushing assembly 72. The second horizontal pushing assembly 72 includes a plurality of transverse pushing devices 76 that ride along a cam track 80. The transverse pushing devices 76 horizontally transfer the clips of sheet material 10 from the transfer buckets 70 into the dispensers 12 on the dispenser conveying device 74.

The dispensers 12 as shown in FIG. 8B are erected in an upright configuration as they travel along the conveyor 74. Various devices and machines are available commercially in order to place the dispensers 12 into an upright configuration. Once placed in the upright configuration, as shown in FIG. 8A, the dispensers are loaded through the side with the clip of sheet material 10.

After being loaded with the sheet material, the side walls of the dispensers 12 are sealed and the dispensers are packaged for shipment to consumers.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed:

1. A system for packaging clips of a sheet material comprising:

a clip transporting conveyor configured to transport a plurality of clips of a sheet material in a downstream direction;

a container transporting conveyor configured to transport a plurality of containers in the downstream direction, the container transporting conveyor being positioned so that the containers move adjacent to a plurality of clips being transported on the clip transporting conveyor;

a vertical bucket conveyor configured to transport a plurality of vertical buckets in the downstream direction, the vertical buckets being suspended above the plurality of containers located on the container transporting conveyor;

a horizontal pushing assembly comprising at least one transverse pushing device, the transverse pushing device being positioned to transversely move clips of a sheet material being transported on the clip transporting conveyor into corresponding vertical buckets moving on the vertical bucket conveyor; and a vertical pushing assembly comprising at least one vertical pushing device, the vertical pushing device being positioned to move downwards through the vertical buckets for transferring a clip of sheet material from the vertical bucket into a corresponding container on the container transporting conveyor.

2. A system as defined in claim 1, wherein the container transporting conveyor is configured to transport dispensers for a sheet material, the container transporting conveyor including a moving guide head that is configured to engage a dispenser moving on the conveyor and to position a dispenser below a corresponding vertical bucket.

3. A system as defined in claim 2, wherein the guide head has an engaging surface that has a shape that mates with a shape of a dispenser moving on the container transporting conveyor.

4. A system as defined in claim 2, wherein the container transporting conveyor further comprises a dispenser spacing device configured to receive a column of dispensers and to space the dispensers apart a desired distance on the container transporting conveyor.

5. A system as defined in claim 1, wherein the vertical buckets on the vertical bucket conveyor comprise a pair of opposing side walls, the side walls being spaced apart so that a clip of sheet material creates a tension fit when loaded into the vertical buckets.

6. A system as defined in claim 1, wherein each vertical bucket on the vertical bucket conveyor is in operative association with a corresponding vertical pushing device.

7. A system as defined in claim 6, wherein the vertical pushing devices move along a cam track that causes the devices to extend through the vertical buckets for transferring a clip of sheet material from the vertical bucket and into one of the containers moving on the container transporting conveyor positioned below the bucket.

8. A system as defined in claim 1, further comprising a clip folding device positioned in operative association with the horizontal pushing assembly, the clip folding device being configured to fold a clip of sheet material as a clip is being loaded into one of the vertical buckets by the transverse pushing device.

9. A system as defined in claim 8, wherein the horizontal pushing assembly comprises a plurality of transverse pushing devices and wherein the clip folding device comprises a corresponding plurality of folding trays, the transverse pushing devices being configured to move along a cam track that causes the devices to extend through one of the corresponding folding trays for folding and transferring a clip of sheet material into one of the vertical buckets.

10. A system as defined in claim 1, wherein each of the vertical buckets on the vertical bucket conveyor is in operative association with a bucket rotating device, the bucket rotating device being configured to rotate a corresponding vertical bucket 90 degrees once the vertical bucket has been loaded with a clip of sheet material so that a clip is transferred into one of the containers in a rotated position.

11. A system as defined in claim 10, wherein the bucket rotation device comprises a linkage arm attached to the corresponding vertical bucket, the linkage arm causing the bucket to rotate when set in motion.

12. A system as defined in claim 1, wherein the containers on the container transporting conveyor comprise transfer buckets and wherein the system further comprises:

a dispenser transporting conveyor configured to transport a stream of dispensers in the downstream direction adjacent to the transfer buckets after the transfer buckets have been loaded with a clip of a sheet material; and a second downstream horizontal pushing assembly comprising at least one transverse pushing device, the transverse pushing device being configured to transversely move clips of a sheet material from one of the transfer buckets into a corresponding dispenser moving on the dispenser transporting conveyor.

13. A system as defined in claim 1, wherein the containers comprise non-rectangular shaped cartons.

* * * * *